United States Patent [19]

Suenaga et al.

[11] Patent Number: 4,889,688

[45] Date of Patent: Dec. 26, 1989

[54] PROCESS OF PRODUCING NODULAR CAST IRON

[75] Inventors: Makoto Suenaga; Fumio Obata, both of Fukuoka; Jun Sakai; Takeshi Natsume, both of Saitama, all of Japan

[73] Assignees: Honda Giken Kogyo K.K.; Hitachi Metals, Ltd., both of Japan

[21] Appl. No.: 273,798

[22] Filed: Nov. 18, 1988

[30] Foreign Application Priority Data

Nov. 20, 1987 [JP] Japan ..... 62-293816

[51] Int. Cl.[4] ..... C22C 33/08

[52] U.S. Cl. ..... 420/22; 420/20; 420/21

[58] Field of Search ..... 420/20–22

[56] References Cited

U.S. PATENT DOCUMENTS

| | | | |
|---|---|---|---|
| 3,113,019 | 12/1963 | Adams | 420/22 |
| 3,421,887 | 1/1969 | Kusaka | 420/22 |
| 3,607,227 | 9/1971 | Stephenson | 420/22 |
| 4,084,962 | 4/1978 | Robinson | 420/22 |
| 4,224,064 | 9/1980 | Bilek | 420/22 |

*Primary Examiner*—Peter D. Rosenberg
*Attorney, Agent, or Firm*—Skjerven, Morrill, MacPherson, Franklin & Friel

[57] ABSTRACT

Conventionally, heat treatment was necessary in the final stage of producing nodular cast iron products to give the nodular cast iron with desired mechanical properties. This was necessary because of the loss of graphitization capability of the molten metal when it is being formed into nodular cast iron during the process of spheroidization, and the heat treatment is therefore required to decompose cementite formation and thereby promote graphitization. The process of producing nodular cast iron according to the present invention can achieve the promotion of graphitization and the increase in the number of graphite nodules, which are both important for the production of high-quality thin-shell cast iron products, through the synergetic effect of processing the molten metal with a graphitization agent such as SiC or $CaC_2$ and of adding a graphite atomization agent such as Bi. The nodular cast iron produced by the process of the present invention can be made into thin-shell products which are provided with favorable mechanical properties either without any heat treatment or at most with low-temperature heat treatment.

13 Claims, 2 Drawing Sheets

(×100)

(×100)

(×100)

(×100)

(×100)

(×100)

PROCESS OF PRODUCING NODULAR CAST IRON

TECHNICAL FIELD

The present invention relates to a process of producing nodular cast iron of superior graphitization capability which makes it suitable for use as thin-shell cast products.

BACKGROUND OF THE INVENTION

For production of nodular cast iron. Fe-Si-Mg alloy or such alloy added with a small amount of RE or rare earth elements is most commonly used as the spheroidization agent in industrial applications. Also, the open ladle addition process or the so-called sandwich process is most commonly used as the spheroidization process.

To the end of improving the graphitization capability of molten metal which has been temporarily reduced by addition of Mg or Mg-RE alloy, an inoculation agent such as various Si alloys or graphite-base substances has been conventionally inoculated into the ladle and/or the flow of the molten metal as it is poured into a mold. However, in industrial applications, since simply performing inoculation after a spheroidization process cannot entirely eliminate the formation of cementite, a heat treatment is required in order to decompose the cementite formation.

Hence, unfavorable consequences such as the increase in the cost and time required for production are inevitable.

The process of producing nodular cast iron which was the subject of a preceding patent application (Japanese patent application No. 61-144591) can produce a favorable chill prevention effect with respect to thin-shell cast iron products, but the present invention has its aim to further improve this prior invention by adding bismuth (Bi) as a graphite atomization agent.

The efficacy of Bi addition to atomize graphite has already been reported, for instance, in AFS Internar., Cast Metals, J, 7(1982), 3, S, 22/31 and FONDERIE BELGE 52 (1982) Nr, 2, S, 5/18, and inoculating agents containing Bi such as SPHERIX (trade name) are commercially available.

However, according to the present invention, through the synergetic effect of processing the molten metal with a graphitization agent including SiC or $CaC_2$ as a major ingredient and of adding Bi, the promotion of graphitization and the increase in the number of graphite nodules, which are both important for the production of high-quality thin-shell cast iron products, can be accomplished. For example, according to the results of a comparison test conducted with respect to the Y-blocks, which were cast from different kinds of nodular cast iron and are each 25 mm in thickness, by taking into account only the graphite nodules having 8 micrometers or greater in diameter, it was observed that, whereas the number of graphite nodules was 300/mm$^2$ according to the process of producing nodular cast iron disclosed in Japanese patent application No. 61-144591, and this number was no more than 300/mm$^2$ when Bi was simply added, the present invention was able to increase this number to 600/mm$^2$.

BRIEF SUMMARY OF THE INVENTION

Thus, a primary object of the present invention is to provide a process of producing nodular cast iron which is free from the formation of cementite when cast into thin-shell products and is provided with a sufficient deformation capability even as cast.

The process of producing nodular cast iron according to the present invention is characterized by the steps of: placing a spheroidization agent and a graphitization promoting agent into a ladle; performing a spheroidization process by charging molten metal having a composition to form nodular cast iron and added with a graphite atomization agent into the ladle; and pouring said molten metal into a mold.

Preferably, inoculation is performed after performing the spheroidization process and before the molten metal has flowed into the cavities in the mold. The spheroidization agent may consist of Mg or material containing Mg, and the graphitization promoting agent may consist of silicon carbide, calcium carbide, silicon carbide and carbon, calcium carbide and carbon, silicon carbide, carbon and Si alloy, or calcium carbide, carbon and Si alloy.

According to a most preferred embodiment of the present invention, the graphite atomization agent consists of Bi or material containing Bi.

BRIEF DESCRIPTION OF THE DRAWINGS

Now the present invention is described in the following with reference to the appended drawings, in which.

DETAILED DESCRIPTION OF THE PREFERRED EMBODIMENTS

Now, various embodiments of the present invention are described in the following.

Embodiment 1

(1) With respect to the weight of the molten metal which is to be charged into a ladle to be formed into nodular cast iron, 1.6% of Fe-Si-Mg (3.5) serving as a spheroidization agent, and 1.0% of silicon carbide and 0.5% of Fe-Si serving as a graphitization promotion agent were placed at the bottom of the ladle.

(2) 0.010% of metallic Bi serving as a graphite atomization agent was added to the molten metal as the latter is being poured into the ladle. The temperature of the molten metal at this time point was 1,525 degrees C.

(3) The thus obtained molten metal contained, in addition to iron and inevitable impurities, the following ingredients:

TABLE 1

| | |
|---|---|
| C | 3.68 (wt %) |
| Si | 2.32 |
| Mn | 0.24 |
| P | 0.021 |
| S | 0.007 |
| Mg | 0.035 |
| Bi | 0.0034 |

Figure 1:
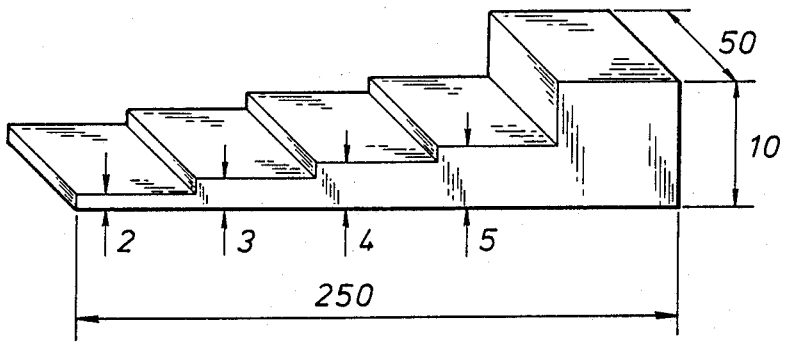
FIG. 1 is a perspective view of the test piece.

(4) A stepped test piece as illustrated in FIG. 1 was obtained by using this molten metal. A certain amount of Fe-Si which is equivalent to 0.1% of Si was inoculated into the flow of the molten metal as the test piece is being cast. The temperature of the molten metal at this time point was 1,410 degrees C.

Figure 2:
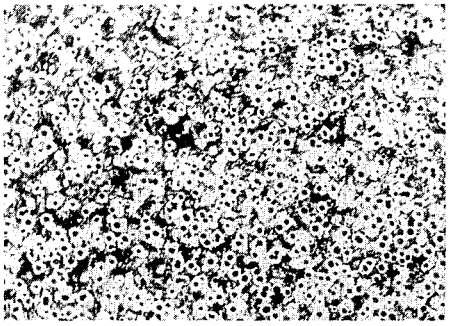
FIGS. 2 through 7 are microscopic photographs of the metallic structures of the various examples of the nodular cast iron produced by the process of the present invention at the magnification factor of 100.

(5) The microscopic view of the part of the test piece which is 2 mm in thickness demonstrated a crystallization of a large number of minute graphite particles without any sign of chilling as shown in FIG. 2. This test piece thus demonstrated an extremely favorable nodular graphite structure.

Embodiment 2

(1) With respect to the weight of the molten metal which is to be charged into a ladle to be formed into nodular cast iron, 1.6% of Fe-Si-Mg (3.5) serving as a spheroidization agent, and 1.0% of silicon carbide, 0.4% of electrode powder and 0.5% of Fe-Si serving as a graphitization promotion agent were placed at the bottom of the ladle.

(2) A certain amount of Fe-Si(71)-Al(0.2)-Ca(0.6)-RE(0.42)-Bi(0.5) alloy equivalent to 0.010% of metallic Bi serving as a graphite atomization agent was added to the molten metal in the furnace immediately before it was poured into the ladel. The temperature of the molten metal at this time point was 1,535 degrees C.

(3) The thus obtained molten metal contained, in addition to iron and inevitable impurities, the following ingredients:

TABLE 2

| | |
|---|---|
| C | 3.66 (wt %) |
| Si | 2.24 |
| Mn | 0.21 |
| P | 0.026 |
| S | 0.008 |
| Mg | 0.035 |
| Bi | 0.0046 |

(4) A stepped test piece as illustrated in FIG. 1 was obtained by using this molten metal. During the casting process, Fe-Si particles formed into briquettes by a suitable binder were placed in the mold right under the sprue, or so-called in-the-mold inoculation was carried out. The amount of the inoculation agent was equivalent to 0.10% of Si. The temperature of the molten metal at this time point was 1,420 degrees C.

Figure 3:
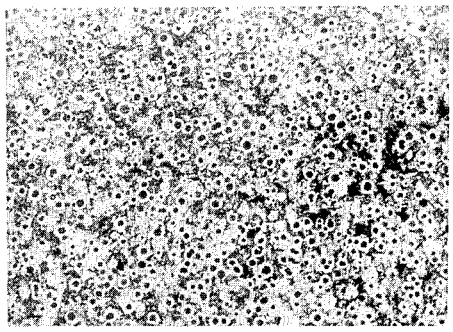

(5) The microscopic view of the part of the test piece which is 2 mm in thickness demonstrated a crystallization of a large number of minute graphite particles without any sign of chilling as shown in FIG. 3. This test piece thus demonstrated an extremelyd favorable nodular graphite structure.

Embodiment 3

(1) With respect to the weight of the molten metal which is to be charged into a ladle to be formed into nodular cast iron, 1.6% of Fe-Si-Mg (3.5) serving as a spheroidization agent, and 1.0% of calcium carbide and 0.5% of Fe-Si serving as a graphitization promotion agent were placed at the bottom of the ladle.

(2) The molten metal which has the composition to be nodular cast iron and added with 0.010% of metallic Bi serving as a graphite atomization agent was charged into the ladle. The temperature of the molten metal at this time point was 1,530 degrees C.

(3) The thus obtained molten metal contained, in addition to iron and inevitable impurities, the following ingredients:

TABLE 3

| | |
|---|---|
| C | 3.70 (wt %) |
| Si | 2.15 |
| Mn | 0.24 |
| P | 0.026 |
| S | 0.007 |
| Mg | 0.034 |
| Bi | 0.0028 |

(4) A stepped test piece as illustrated in FIG. 1 was obtained by using this molten metal. A certain amount of Fe-Si which is equivalent to 0.1% of Si was inoculated into the flow of the molten metal as the test piece is being cast. The temperature of the molten metal at this time point was 1,415 degrees C.

Figure 4:
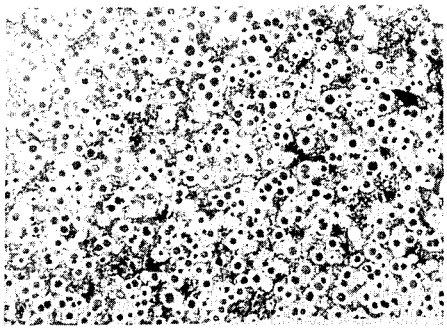

(5) The microscopic view of the part of the test piece which is 2 mm in thickness demonstrated a crystallization of a large number of minute graphite particles without any sign of chilling as shown in FIG. 4. This test piece thus demonstrated an extremely favorable nodular graphite structure.

Embodiment 4

(1) With respect to the weight of the molten metal which is to be charged into a ladle to be formed into nodular cast iron, 1.6% of Fe-Si-Mg (3.5) containing 1.5% of RE and serving as a spheroidization agent, and 1.0% of silicon carbide and 0.5% of Fe-Si serving as a graphitization promotion agent were placed at the bottom of the ladle.

(2) The molten metal which has the composition to be nodular cast iron and added with 0.010% of metallic Bi serving as a graphite atomization agent was charged into the ladle. The temperature of the molten metal at this time point was 1,510 degrees C.

(3) The thus obtained molten metal contained, in addition to iron and inevitable impurities, the following ingredients:

TABLE 4

| | |
|---|---|
| C | 3.68 (wt %) |
| Si | 2.25 |
| Mn | 0.22 |
| P | 0.024 |
| S | 0.007 |
| Mg | 0.038 |
| Bi | 0.0045 |

(4) A stepped test piece as illustrated in FIG. 1 was obtained by using this molten metal. A certain amount of Fe-Si which is equivalent to 0.1% of Si was inoculated into the flow of the molten metal as the test piece is being cast. The temperature of the molten metal at this time point was 1,415 degrees C.

Figure 5:
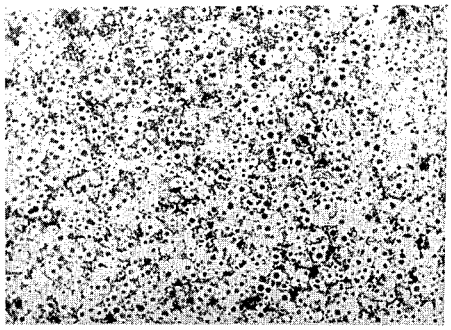

(5) The microscopic view of the part of the test piece which is 2 mm in thickness demonstrated a crystallization of a large number of minute graphite particles without any sign of chilling as shown in FIG. 5. This test piece thus demonstrated an extremely favorable nodular graphite structure.

Embodiment 5

(1) With respect to the weight of the molten metal which is to be charged into a ladle to be formed into nodular cast iron, 1.6% of Fe-Si-Mg (3.5) containing 1.5% of RE and serving as a spheroidization agent, and 1.0% of silicon carbide, 0.4% of electrode powder and 0.5% of Fe-Si serving as a graphitization promotion agent were placed at the bottom of the ladle.

(2) The molten metal which has the composition to be nodular cast iron and added with 0.010% of metallic Bi serving as a graphite atomization agent was charged into the ladle. The temperature of the molten metal at this time point was 1,510 degrees C.

(3) The thus obtained molten metal contained, in addition to iron and inevitable impurities, the following ingredients:

TABLE 5

| | |
|---|---|
| C | 3.71 (wt %) |

TABLE 5-continued

| | |
|---|---|
| Si | 2.36 |
| Mn | 0.24 |
| P | 0.026 |
| S | 0.008 |
| Mg | 0.037 |
| Bi | 0.0038 |

(4) A stepped test piece as illustrated in FIG. 1 was obtained by using this molten metal. During the casting process, Fe-Si particles formed into briquettes by a suitable binder were placed in the mold right under the sprue, or so-called in-the-mold inoculation was carried out. The amount of the inoculation agent was equivalent to 0.10% of Si. The temperature of the molten metal at this time point was 1,410 degrees C.

Figure 6:
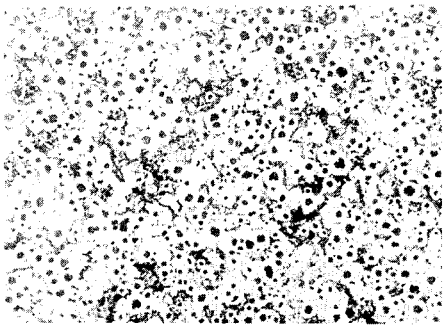

(5) This microscopic view of the part of the test piece which is 2 mm in thickness demonstrated a crystallization of a large number of minute graphite particles without any sign of chilling as shown in FIG. 6. This test piece thus demonstrated an extremely favorable nodular graphite structure.

Embodiment 6

(1) With respect to the weight of the molten metal which is to be charged into a ladle to be formed into nodular cast iron, 1.6% of Fe-Si-Mg (3.5) containing 1.5% of RE and serving as a spheroidization agent, and 1.0% of calcium carbide, 0.4% of electrode powder and 0.5% of Fe-Si serving as a graphitization promotion agent were placed at the bottom of the ladle.

(2) The molten metal added with a certain amount of Fe-Si(71)-Al(0.2)-Ca(0.6)-RE(0.42)-Bi(0.5) alloy equivalent to 0.010% of metallic Bi serving as a graphite atomization agent was charged into the ladle. The temperature of the molten metal at this time point was 1,525 degrees C.

(3) The thus obtained molten metal contained, in addition to iron and inevitable impurities, the following ingredients:

TABLE 6

| | |
|---|---|
| C | 3.64 (wt %) |
| Si | 2.23 |
| Mn | 0.26 |
| P | 0.027 |
| S | 0.007 |
| Mg | 0.033 |
| Bi | 0.0049 |

(4) A stepped test piece as illustrated in FIG. 1 was obtained by using this molten metal. During the casting process, Fe-Si particles formed into briquettes by a suitable binder were placed in the mold right under the sprue, or so-called in-the-mold inoculation was carried out. The amount of the inoculation agent was equivalent to 0.10% of Si. The temperature of the molten metal at this time point was 1,415 degrees C.

Figure 7:
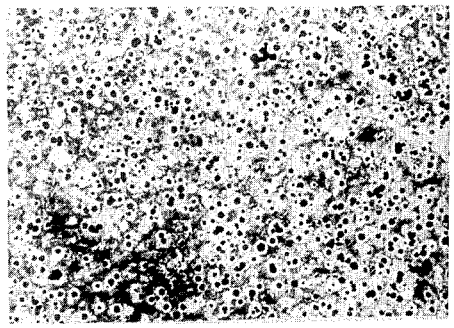

(5) The microscopic view of the part of the test piece which is 2 mm in thickness demonstrated a crystallization of a large number of minute graphite particles without any sign of chilling as shown in FIG. 7. This test piece thus demonstrated an extremely favorable nodular graphite structure.

The features of the nodular cast iron produced by the process of the present invention may be summarized as follows:

With regard to a cast product of a given thickness,

1. The number of graphite particles is twice more than that of conventional nodular cast iron, and, hence, no chilling occurs;

2. Absence of chilling even in thin-shell products means that the products may be usable as cast or, at most, after low-temperature heat treatment whereby a saving in the cost of heat treatment can be achieved; and 3. Whereas high-temperature heat treatment of cast products having complicated shapes increases the strain in the products, the possibility of using the products as cast or after low-temperature heat treatment eliminates the need for any process of eliminating such strain.

Thus, as described above, the nodular cast iron produced by the process of the present invention is highly inexpensive to produce since the production process is much simplified, and the present invention thus offers a substantial advantage in industrial applications.

What we claim is:

1. A process of producing nodular cast iron, comprising the steps of:

placing a spheroidization agent and a graphitization promoting agent into a ladle;

adding a graphite atomization agent to a molten metal having a composition to form nodular cast iron;

performing a spheroidization process by charging said molten metal into the ladle; and pouring said molten metal from said ladle into a mold.

2. A process of producing nodular cast iron as defined in claim 1, wherein inoculation using said graphitization agent is performed after performing the spheroidization process and before the molten metal has flowed into the mold.

3. A process of producing nodular cast iron as defined in claim 1, wherein the spheroidization agent consists essentially of Mg or material containing Mg.

4. A process of producing nodular cast iron as defined in claim 1, wherein the graphitization promoting agent consists essentially of silicon carbide, silicon carbide and carbon, or silicon carbide, carbon and Si alloy.

5. A process of producing nodular cast iron as defined in claim 1, wherein the graphitization promoting agent consists essentially of calcium carbide, calcium carbide and carbon, or calcium carbide, carbon and Si alloy.

6. A process of producing nodular cast iron as defined in any one of the preceding claims, wherein the graphite atomization agent consists essentially of Bi or material containing Bi.

7. A process of producing nodular cast iron comprising the steps of:

placing a spheroidization agent and a calcium carbide-containing or silicon carbide-containing graphitization promoting agent into a ladle;

adding a bismuth-containing graphite atomization agent into a molten metal having a composition to form nodular cast iron;

performing a spheroidization process by charging said molten metal into said ladle; and pouring the resultant cast iron into a mold.

8. The process of claim 7 wherein said graphitization agent consists essentially of silicon carbide; silicon carbide and carbon; or silicon carbide, carbon and a silicon alloy.

9. The process of claim 8 wherein said graphitization agent comprises about 1.0% by weight silicon carbide.

10. The process of claim 7 wherein said graphitization agent consists essentially of calcium carbide; calcium carbide and iron; or calcium carbide, carbon and silicon alloy.

11. The process of claim 10 wherein said graphitization agent comprises about 1.0% by weight calcium carbide.

12. The process of claim 7 wherein the amount of bismuth-containing graphite atomization agent is about 0.01% of metallic bismuth or a Si-Al-Ca-rare earth-Bi alloy equivalent to about 0.01% metallic bismuth.

13. The process of claim 7 wherein the resultant molded cast iron is characterized by having a number of spheroidal graphite nodules of at least of at least of $600/mm^2$.

* * * * *